US011213108B2

(12) United States Patent
Meranus

(10) Patent No.: US 11,213,108 B2
(45) Date of Patent: Jan. 4, 2022

(54) CARTRIDGE FOR AN APPLICATOR CONTAINER

(71) Applicant: Margaret Spicer Meranus, Cincinnati, OH (US)

(72) Inventor: Margaret Spicer Meranus, Cincinnati, OH (US)

( * ) Notice: Subject to any disclaimer, the term of this patent is extended or adjusted under 35 U.S.C. 154(b) by 0 days.

(21) Appl. No.: 16/332,139

(22) PCT Filed: Sep. 7, 2017

(86) PCT No.: PCT/US2017/050496

§ 371 (c)(1),
(2) Date: Mar. 11, 2019

(87) PCT Pub. No.: WO2018/049039

PCT Pub. Date: Mar. 15, 2018

(65) Prior Publication Data

US 2019/0357658 A1 Nov. 28, 2019

Related U.S. Application Data

(63) Continuation-in-part of application No. 15/598,502, filed on May 18, 2017, now Pat. No. 9,950,854.
(Continued)

(51) Int. Cl.
*A45D 40/16* (2006.01)
*A45D 40/26* (2006.01)
(Continued)

(52) U.S. Cl.
CPC ..... *A45D 40/16* (2013.01); *A45D 40/262* (2013.01); *A46B 1/00* (2013.01); *A46B 11/0003* (2013.01)

(58) Field of Classification Search
CPC .... A45D 40/0087; A45D 40/16; A45D 40/20; A45D 40/204; A45D 2040/0025;
(Continued)

(56) References Cited

U.S. PATENT DOCUMENTS 1,694,364 A * 12/1928 Albright ..... A46B 15/00 15/192
1,823,814 A 9/1931 Aiello
(Continued)

FOREIGN PATENT DOCUMENTS

| | | | |
|---|---|---|---|
| EP | 0697182 | A2 | 2/1996 |
| EP | 1535557 | A1 | 6/2005 |
| WO | 2012/013542 | A1 | 2/2012 |

OTHER PUBLICATIONS

"Chanel Lip Gloss Pendant", internet search at www.google.com/search?q=chanel+lip+gloss+pendant, available to inventor prior to Dec. 19, 2016 (1 page).
(Continued)

*Primary Examiner* — David P Angwin
*Assistant Examiner* — Bradley S Oliver
(74) *Attorney, Agent, or Firm* — Daniel F. Nesbitt; Hasse & Nesbitt LLC

(57) ABSTRACT

A discardable cartridge (310) having a limited quantity of a lip balm that is loaded into a closable applicator container, such as a piece of jewelry or a wearable accessory. The cartridge includes a rigid or resilient upper base (312) having a convex or flat top surface (314) upon which the lip balm is associated, and a volume of lip balm attached to the top surface of the base. The flat or convex top surface allows wiping the balm onto the lips single-handedly. The top surface of the cartridge includes a plurality of integrally-attached bristles (330, 332), between which the lip balm is
(Continued)

embedded, anchoring the lip balm to the cartridge, and providing the additional function of exfoliation.

17 Claims, 13 Drawing Sheets

Related U.S. Application Data

(60) Provisional application No. 62/393,264, filed on Sep. 12, 2016.

(51) Int. Cl.
*A46B 11/00* (2006.01)
*A46B 1/00* (2006.01)

(58) Field of Classification Search
CPC .... A45D 2040/0031; A45D 2040/0043; A45D 2040/005; A45D 2040/0056; A45D 2040/0062; A45D 40/262; A46B 9/005; A46B 9/028; A46B 11/0003; A46B 1/00; A46B 2200/405; A46B 3/005
USPC ..... 401/88
See application file for complete search history.

(56) References Cited

U.S. PATENT DOCUMENTS

| | | | | |
|---|---|---|---|---|
| 4,432,114 | A | 2/1984 | Goudsmit | |
| 5,403,105 | A | 4/1995 | Jameson | |
| 5,609,430 | A * | 3/1997 | Mazzola | A45D 40/04 401/68 |
| 5,680,679 | A | 10/1997 | May | |
| 6,056,469 | A | 5/2000 | Algorri | |
| D427,379 | S | 6/2000 | Thorpe | |
| 6,283,658 | B1 | 9/2001 | Estevez et al. | |
| 6,926,166 | B1 | 8/2005 | Bitton et al. | |
| 7,309,185 | B2 * | 12/2007 | Thorpe | A45D 34/042 401/172 |
| 7,785,026 | B2 | 8/2010 | Eng et al. | |
| D625,216 | S | 10/2010 | Morgan | |
| 7,954,640 | B2 | 6/2011 | West et al. | |
| 8,550,736 | B2 | 10/2013 | Hohlbein et al. | |
| 8,747,002 | B2 | 6/2014 | Izkovitz | |
| 9,044,079 | B2 | 6/2015 | Silvers | |
| 9,049,915 | B2 * | 6/2015 | Caulier | A45D 40/24 |
| 9,131,758 | B2 | 9/2015 | Stein | |
| 2005/0117962 | A1 | 6/2005 | Lion et al. | |
| 2005/0191110 | A1 | 9/2005 | Bitton | |
| 2008/0245104 | A1 | 10/2008 | Steele | |
| 2010/0279040 | A1 | 11/2010 | West et al. | |
| 2011/0204015 | A1 | 8/2011 | West et al. | |
| 2012/0234336 | A1 * | 9/2012 | Paquet | A45D 40/262 132/200 |
| 2013/0014312 | A1 | 1/2013 | Izkovitz | |
| 2016/0183670 | A1 * | 6/2016 | Brewer | A46B 15/0006 15/22.1 |

OTHER PUBLICATIONS

"Dispicable Me Minion Lip Gloss Watch", internet search at www.birthdaydirect.com/minions-lip-gloss-watch-p-53747.html, available to inventor prior to Dec. 19, 2016 (2 pages).

"My Little Pony Slap Bracelet Lip Gloss Set", internet result at www.google.com/search?q=my+little+pony+slap+bracelet+lip+gloss+set, available to inventor prior to Dec. 19, 2016 (2 pages).

"Baby-Kids Finger Toothbrush", internet search at www.aliexpress.com/item/2pcs-baby-kids-finger-toothbrush-soft-silicone-infant-newborn-brush-tool-baby-teether-training-toothbrush, available to inventor prior to Dec. 19, 2016 (3 pages).

International Search Report and Written Opinion of the International Searching Authority dated Nov. 16, 2017 for related International Application No. PCT/US2017/050496, filed Sep. 7, 2017 (14 pages).

* cited by examiner

CARTRIDGE FOR AN APPLICATOR CONTAINER

CROSS REFERENCE TO RELATED APPLICATIONS

This application is a 371 national phase entry of International Application No. PCT/US2017/050496 filed Sep. 9, 2017, which claims the benefit of U.S. Provisional Application No. 62/393,264 filed Sep. 12, 2016, and which is also a continuation-in-part of U.S. Non-provisional application Ser. No. 15/598,502 filed May 18, 2017, now U.S. Pat. No. 9,950,854 issued Apr. 24, 2018, which claims the benefit of U.S. Provisional Application No. 62/393,264 filed Sep. 12, 2016, the disclosures of which are disclosed herein by reference in their entireties.

FIELD OF THE INVENTION

The present invention relates to an applicator container for a personal care composition.

BACKGROUND OF THE INVENTION

Personal care compositions, particularly lip balm and lip gloss, are well-known commercial products that are typically used by both men and women. Many versions of these products in the marketplace have several shortcomings. Some dispensers and applicators are so small that they are easily lost, and they can be misplaced in a purse, backpack, vehicle, or jacket. Other dispensers and applicators are often bulky and awkward to store in either a small purse or pocket. In some public places, regulations or rules may prevent bringing a bag to store the dispenser or applicator, and in some circumstances, the dispensers or applicators can even be prohibited. Even when a particular dispenser or applicator can be conveniently transported in an appropriately-sized bag or pocket, they can often become unsanitary after several applications of the personal care composition.

In light of all of the above issues, several devices have been developed to provide portable versions of common personal care compositions, and have been disclosed in U.S. Pat. Nos. 6,283,658, 7,309,185, 7,785,026, and 8,747,002, and U.S. Pat. Pubs. 2012/0234336 and 2013/0014312, the disclosures of which are incorporated by reference in their entireties.

SUMMARY OF THE INVENTION

The present invention provides an article of manufacture as a limited-use, personal care product in an applicator container, comprising a cartridge containing a volume of a personal care composition that can be loaded into an applicator container. When the personal care composition has been depleted from the loaded cartridge after a limited use time or number of uses, the cartridge can be unloaded, discarded, and replaced by a fresh, new cartridge.

The invention also includes a cartridge for a personal care composition, comprising: a) a rigid or resilient body including an upper base having a top surface that has a flat, planar or convex shape; b) a volume of personal care composition attached to the top surface of the upper base; and c) a means for securing the cartridge body releasably into the receptacle of a separate applicator container. The maximum height of the volume of personal care composition is less than or equal to the maximum length of the cartridge base, where the height of the personal care composition is measured from the uppermost surface of the upper base. Typically, this is measured from the center of the top surface. When a cartridge is secured inside the receptacle of an applicator container, the top surface of the upper base is flush with, or slightly raised above, the upper rim of the applicator container so that the entire personal care composition attached to the surface of the cartridge can be applied.

In another embodiment of the invention, the personal care composition is an external-use, non-ingestible substance selected from a group consisting of a cosmetic, therapeutic, hygienic, and skin-care composition.

In a further embodiment of the invention, the personal care composition is lip balm.

In another embodiment of the invention, the cartridge body, the top surface of the upper base, and the personal care composition are essentially coaxial with one another around a common axis.

In a further embodiment of the invention, the cartridge is symmetrical around the common axis.

In an embodiment of the invention, the personal care composition disposed on the upper base's top surface can be swiped with one hand, or single-handedly, across the lips or other body part.

In another embodiment of the invention, the invention includes a cartridge useful for containing a personal care composition, comprising a rigid or resilient body including an upper base having a top surface and an under surface, and a plug having an outer sidewall, the plug extending from the under surface of the upper base, the plug configured for mounting in an applicator container, and a plurality of resilient, elongated protuberances extending from and attached integrally to the top surface of the base. The cartridge can include an optional means for securing the body of the cartridge releasably into a receptacle of a separate applicator container. A base end of each protuberance is attached integrally to the top surface of the upper base of the cartridge. The top surface of the upper base with integrally-attached protuberances can be flat, planar, convex, or concave. The lengths of each of the protuberances can be constant or varied so that their distal ends form a contact surface of the protuberances, from which to apply a portion of a personal care composition. The contact surface defined by the distal ends of each of the plurality of protuberances can be flat, domed, angled, dished, cavitied, or variable. In one embodiment, the plurality of resilient, elongated protuberances include an outer ring or periphery of protuberances disposed on the top surface of the base.

The plurality of protuberances can have constant cross-sectional dimension, or diameter, from the base end to the distal end, or can have a slightly tapered cross-sectional dimension, or diameter, along its length, defining an average cross-sectional dimension or diameter.

The plurality of protuberances can have an aspect ratio, defined by a ratio of the length of the protuberance from the base end to the distal end, to the diameter or average diameter. All of the protuberances can have the same aspect ratio, or one or more of the protuberances can have a first aspect ratio, and one or more remaining protuberances can have a second aspect ratio. In other embodiments, the protuberances can include a plurality of groups of one or more protuberances, each group having a different aspect ratio. An aspect ratio of a protuberance can be at least about 1:1, including at least about 2:1, or at least about 3:1, or at least about 4:1, or at least about 5:1, or at least 6:1, or at least 8:1. The aspect ratio of a protuberance can be up to about 15:1, including up to about 12:1, or up to about 10:1, up to about 8:1, up to about 6:1, and up to about 4:1.

In an embodiment of the invention, a substantial portion of the plurality of protuberances have an aspect ratio of at least 3:1, more particularly at least 4:1, and even more particularly at least 5:1. In another embodiment, at least 25% of the plurality of protuberances have an aspect ratio of at least 3:1, more particularly at least 4:1, and even more particularly at least 5:1. In another embodiment, at least 50% of the plurality of protuberances have an aspect ratio of at least 3:1, more particularly at least 4:1, and even more particularly at least 5:1.

The cartridge can be secured inside any applicator container configured to receive the cartridge, including applicator containers that have sidewalls that extend above the top surface of the cartridge.

In a further embodiment of the invention, the plurality of protuberances is comprised of a plurality of silicone bristles.

In further embodiment of the invention, a personal care composition can be embedded between the protuberances, and to the top surface of the upper base, anchoring the personal care composition to the upper base of the cartridge. Personal care compositions can be embedded between the protuberances either before or after the cartridge is secured inside an applicator container.

In an embodiment of the invention, the plug has an axially-extending groove formed into its outer sidewall, to provide a vent for air that may be trapped with a receptacle. The upper base can also have a radially-extending groove formed into the under surface, extending from the juncture of the plug with the upper base, to the outer sidewall of the upper base, in fluid communication with the axially-extending groove to form a unitary vent channel.

In an embodiment of the invention, the cartridge body has a bore formed axially into the plug, and can extend axially through the body. In one particular embodiment, the bore extends through from a bottom surface of the plug, to the top surface of the upper base, to define a passage there between. In one aspect of the invention, the bore provides a cavity into which the surrounding material of the plug can expand when the plug is being pressed into a capturing bore or void in an applicator container that provides a receptacle for the product cartridge. In another aspect, the bore serves as a vent for the escape of any air or gases that might become trapped near the top surface of the upper base when a volume of personal care composition is placed onto and among the protuberances and the top surface.

In another embodiment of the invention, a cartridge can further include a covering that envelops and protects the personal care composition from debris and other contaminants, which can be removed and discarded prior to insertion of the cartridge into the receptacle of the applicator container, or after insertion of the cartridge and prior to the first application of the personal care composition on the lips or skin of the user. The covering can be reusable or discardable.

In a further embodiment of the invention, the covering further includes a rigid or resilient cap that can be frictionally or mechanically secured to the cartridge base or personal care composition. Exemplary mechanical securements can include snap beads and detents, complementary screw threads, a mounting post and slot mechanism, and a lever and a catch. The cover can also include one or more protecting wraps that can temporarily secure the lower rim of a cap to the perimeter edge of a cartridge base.

In a further embodiment of the invention, the cap is closed on one end by an upper wall, and includes a cylindrical sidewall and at least one cap projection that extends axially from an inside surface of the upper wall, that extends into the personal care composition when the cap is secured to the upper base of the cartridge or the personal care composition. The cap projection can provide a rigid body through which a user can apply pressure to frictionally fit a cartridge inside a receptacle of an applicator container without damaging the personal care composition.

In another embodiment of the invention, the means for securing the cartridge body into an applicator container further includes a receptacle in the applicator container that is configured to receive and retain the body of the cartridge within the receptacle.

In a further embodiment of the invention, the receptacle has an annular interior sidewall and a plug of the cartridge body has an annular sidewall that frictionally engages with a portion of the annular interior sidewall of the receptacle, securing the cartridge inside the receptacle of the applicator container.

Alternatively, the cartridge body can have a receptacle that has an annular interior sidewall and the applicator container can have a plug having an annular wall that frictionally engages with a portion of the annular interior sidewall of the receptacle on the cartridge body, securing the cartridge inside the applicator container.

In a further embodiment of the invention, the cartridge body can be secured into an applicator container by a mechanical fastener. Exemplary mechanical fasteners include a slide and track mechanism, a finger latch mechanism, a mounting post and receiving slot mechanism, complimentary screw threads, a lever and catch, twist lock closures, a pair of magnets of opposite polarity, a hook material and a loop material, or snap beads and snap detents.

In another embodiment of the invention, the applicator container is a closable applicator container that includes a closure that is removable from its position over the receptacle. The closable applicator container can also include a fastener comprising a first fastener element on the receptacle, and a second fastener element on the removable closure, to releasably fasten the removable closure to the receptacle. When the removable closure is unfastened, the personal care composition within the cartridge is uncovered and revealed.

In a further embodiment of the invention, the user can swipe and apply a portion or any remaining portion of the entire volume of personal care composition, unimpeded by the removed closure. The unfastened removable closure can be separable from the closable applicator container, or a portion of the closure can remain attached to the closable applicator container, such as with a hinge, while the user accesses and applies the personal care composition. The fastener can be selected from the group consisting of a lever and catch, kiss locks, a twist lock closure, a mounting post and post-receiving slot mechanism, a snap stud and snap socket, snap beads and snap detents, a buckle and clasp, a hook material and a loop material, complementary screw threads, and a pair of magnets of opposite polarity.

In another embodiment of the invention the closable applicator container can dispense and apply substantially all of the composition from the surface of the cartridge, without needing to or requiring dipping a finger down into the receptacle or cartridge.

In another embodiment of the invention, the closable applicator container can be configured to store the cartridge when not in use.

In another embodiment of the invention, the closable applicator container can further include an outer wall, a portion of which is elliptical or oval-shaped. The elliptical or oval-shaped portion of the outer wall defines an elongate or arcuate gripping surface that facilitates single-handed operation of the closable applicator container. The elliptical or oval-shaped portion of the outer wall can be configured to fit between the base of the user's thumb and forefinger and enable the applicator container to rest flat against a user's chest when the closable applicator container is worn as a necklace or locket.

In another embodiment of the invention, the closable applicator container can be a piece of jewelry or wearable accessory.

A further embodiment of the invention is a cartridge and an applicator container for a personal care composition that are configured to be handled and be applied by a user with one hand, or single-handedly, or both hands, and without the user touching the personal care composition with a finger when applying.

In another embodiment of the invention, the cartridges can be configured to be loaded into commonly-available applicator containers, including but not limited to lip balm tubes, lipstick applicators, makeup or cosmetic containers, and other dispensing apparatuses. Cartridges can also be configured to be loaded and secured within the applicator containers of commercially-available personal care products, particularly lip balm products, to recharge the applicator container after its contents have been depleted.

In another embodiment of the invention, the applicator container further includes an ejector for controllably ejecting the cartridge from the applicator container. Ejectors can be selected from a group consisting of a threaded rod and turnwheel or an elevator platform.

Known applicator containers generally do not permit the entire quantity of a personal care composition, particularly lip balm, to be dispensed from its dispensing container, either because the composition must either be dispensed or squeezed out of an internal container or housing, or it is loaded into a receptacle where much of the composition is below the surface of what can actually be applied. Where only a small quantity of personal care product is provided, the large amount of wasted material limits the composition's utility. The cartridge of the present invention can hold a small quantity of a personal care composition (such as a day's supply or less than ten applications), and the entire quantity can be used or applied with little or no waste. The composition can be housed in a closable applicator container, such as a piece of jewelry, for ease of transport and to prevent the cartridge, composition, or container from becoming unsanitary over time.

These and other objects and features of the present invention will become apparent to one skilled in the art from the following description and accompanying drawings. It is to be understood that the drawings are designed for illustration purposes only and are not intended to define the limit or scope of the present invention.

BRIEF DESCRIPTION OF THE DRAWINGS

The embodiment, aspects and advantages of the invention other than those set forth above will become apparent when consideration is given to the following detailed description thereof. Such description makes reference to the annexed drawings.

DETAILED DESCRIPTION OF THE INVENTION

The present invention relates to a disposable cartridge that includes a limited quantity of a personal care composition. The cartridge can include a rigid or resilient upper base having a top surface that is flat, planar, or convex. A volume of personal care composition is applied and attached to the top surface of the upper base. The cartridge can include a means for mechanically or frictionally securing the cartridge releasably into a closable applicator container, which can be configured to store the cartridge when the personal care composition is not being used. Once the volume of personal care composition has been depleted substantially completely, the empty cartridge can be unloaded, discarded, and replaced by a fresh, new cartridge. Similarly, a cartridge having a volume of personal care composition can be transferred from one applicator container to another applicator container without affecting the quantity or utility of the personal care composition attached to the cartridge.

Figure 1:
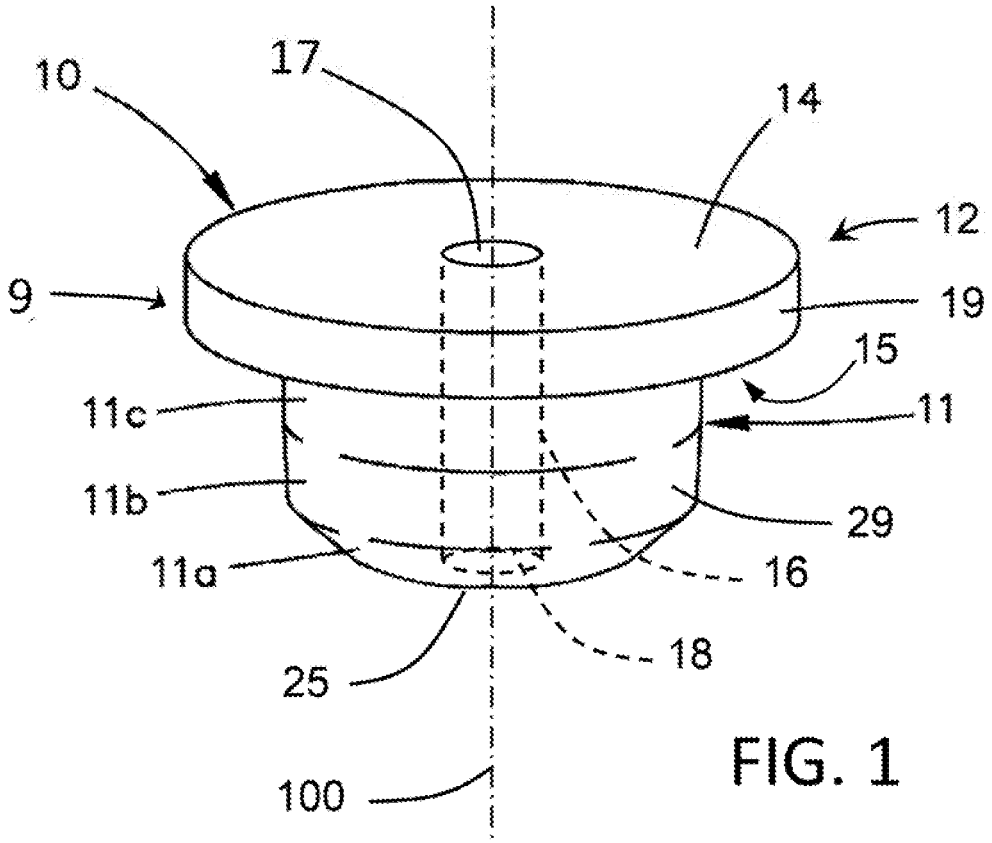
FIG. 1 is a top perspective view of a cartridge including an upper base that has a flat top surface.

The upper base of the cartridge can be made of any rigid or resilient material, including but not limited to metallic or thermoplastic materials, or inert synthetic polymers, such as polysiloxane, which is commonly referred to as silicone. FIG. 1 illustrates an empty cartridge 10 (a cartridge without the personal care composition) including a body 9 that includes an upper base 12 that has an outer sidewall 19 and a flat top surface 14. The body includes a plug 11 having an outer sidewall 29 that extends perpendicular to the upper base 12, or the plug 11 can be configured into two or more segments 11*a*, 11*b*, and 11*c* that taper inward to facilitate a frictional fit inside the receptacle of an applicator container. The outer sidewall 29 can have an annular shape.

Figure 6:
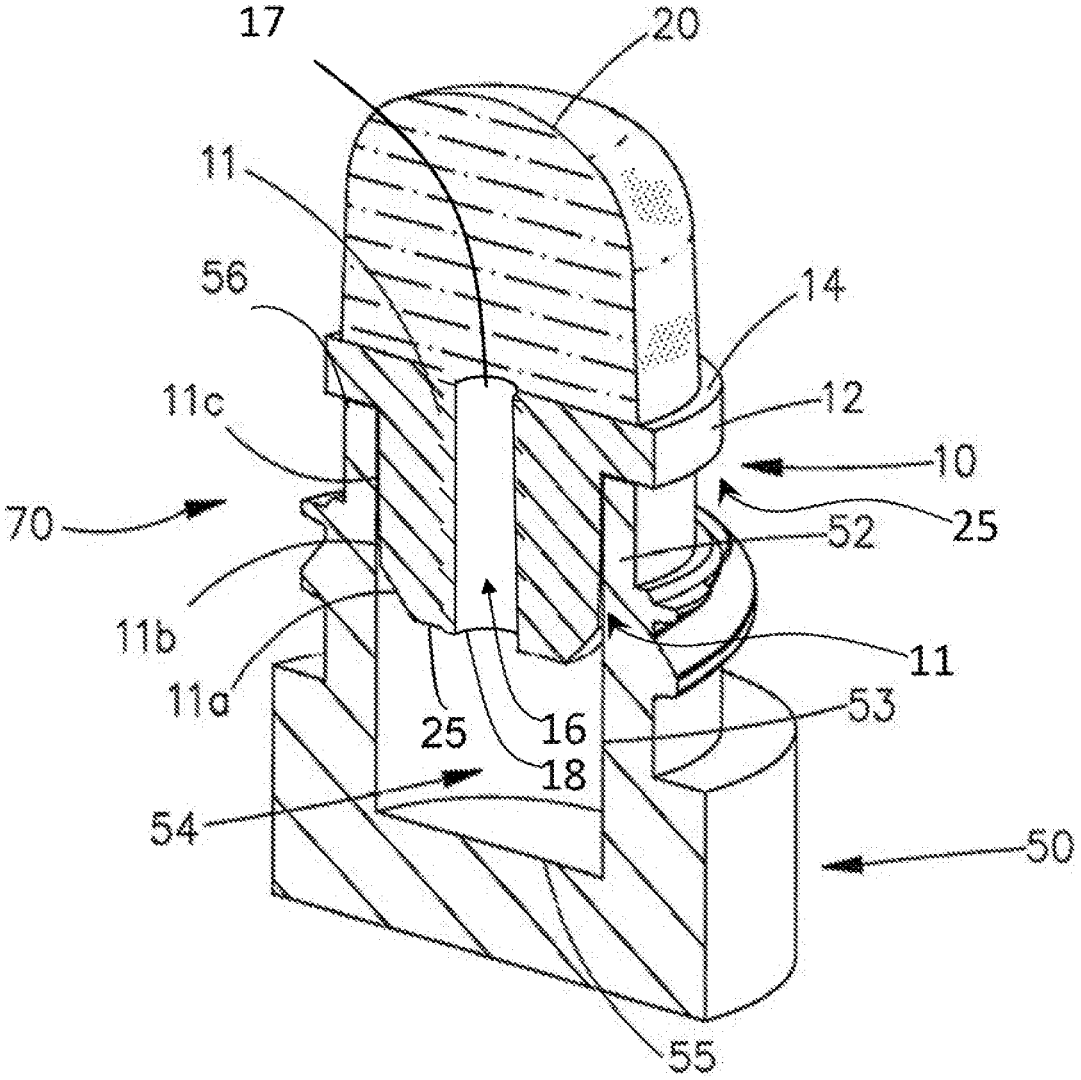
FIG. 6 is a sectional view of the personal care product in FIG. 5, taken through line 6-6.

In an embodiment of the cartridge 10, the body illustrated in FIG. 6 has a bore 16 formed axially into the plug 11. The bore 16 can be a cylindrical bore, and can extend along the centerline axis of the body. The bore 16 can extend through a bottom surface 25 of, and into, the plug 11 to define an opening 18. A distal end of the bore 16 can extend beyond the plug 11 and into the upper base 12. In the illustrated embodiment, the bore 16 can extend through the top surface 14 of the upper base 12 to define an opening 17 in the top surface 14 of the upper base 12. The bore 16 can provide a pathway through, and fluid communication between, the top surface 14 of the upper base 12, and the under surface 25 of the plug 11.

In another embodiment of the invention, the bore 16 can be positioned radially away from the centerline axis 100 of the plug and upper base 12, while in another embodiment, there can be two or more bores, spaced apart along the top surface 14 of the upper base 12. The bore 16 is typically slightly tapered along its axial length, inwardly and away from the bottom 25, to aid in the molding process.

In one aspect of the invention, the bore 16 provides a cavity into which the surrounding material of the plug 11 can expand elastically when the plug 11 is being pressed into a capturing bore or void 54 that provides a receptacle for the cartridge in the applicator container, as described herein later. Preferably, the cross-sectional size of the bore 16 is sufficient to permit the elastic compression of the material of the plug 11. In another embodiment illustrated in FIG. 13, the portion of the bore 16 through the upper base 12 can be a different size or diameter than that of the portion of the bore 16 through the plug 11, and in one such embodiment, the diameter or size of the bore 16 through the upper base 12 is smaller, and preferably about half, or less, the diameter or size of the bore 16 through the plug 11.

The bore 16 in the cartridge body 9 also can serve as a vent for the escape of any air or gases that might become trapped near the top surface 14 of the upper base 12 when the volume of personal care composition is placed onto the top surface 14. In such embodiment, the bore 16 extends from the opening 17 in the top surface 14 to the opening 18 in the bottom or under surface 25 of the plug. This can improve the consistency and effectiveness of the personal care composition mounted onto the cartridge. Preferably, the cross-sectional size of the bore(s) 16 is sufficient to permit any air or gas to vent from under the personal care composition during application of the composition to the top surface 14 of the upper base 12.

Figure 2:
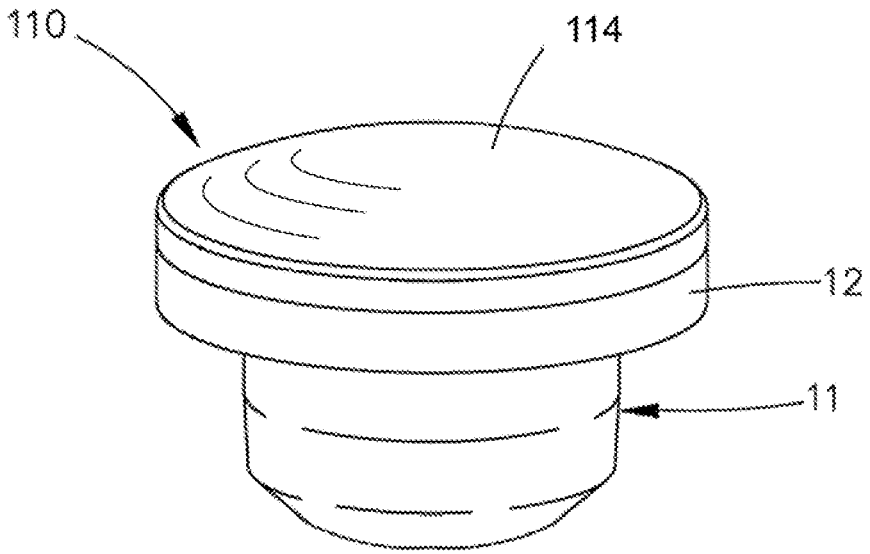
FIG. 2 is a top perspective view of another embodiment of a cartridge including an upper base that has a convex top surface.

In an alternative embodiment, as illustrated in FIG. 2, a cartridge 110 can include a body that includes a plug 11 and an upper base 12 that has a convex top surface 114.

In another embodiment, the top surface of the upper base can be planar. Configuring the top surface of the upper base to be flat, convex, or planar can enable the user to access and apply the entire volume of the personal care composition that is attached to the cartridge by wiping the surface of the base across the lips, skin, or other body part. In some embodiments, the top surface 14 or 114 is essentially circular, as shown in FIGS. 1 and 2. However, the top surface of the cartridge configured into any shape to facilitate the loading of the cartridge inside an applicator container or the application of a personal care product.

The personal care composition can be any external-use, non-ingestible substance that can be effectively attached or associated with the top surface of the cartridge, and can be solid, semi-solid, gel-based, or wax-based. The substance can be applied for cosmetic, therapeutic, hygienic, or skin-care applications, including such non-limiting examples as lip balm, lip gloss, lipstick, mascara, foundation, concealers, blemish removers, creams, aloes, lotions, ointments, and deodorants. In some embodiments of the invention, the personal care composition is lip balm.

In an alternative embodiment, the composition can be a home or personal use composition, such as, by non-limiting example, a cooking or baking grease, a detergent composition, a show polish.

Figure 3:
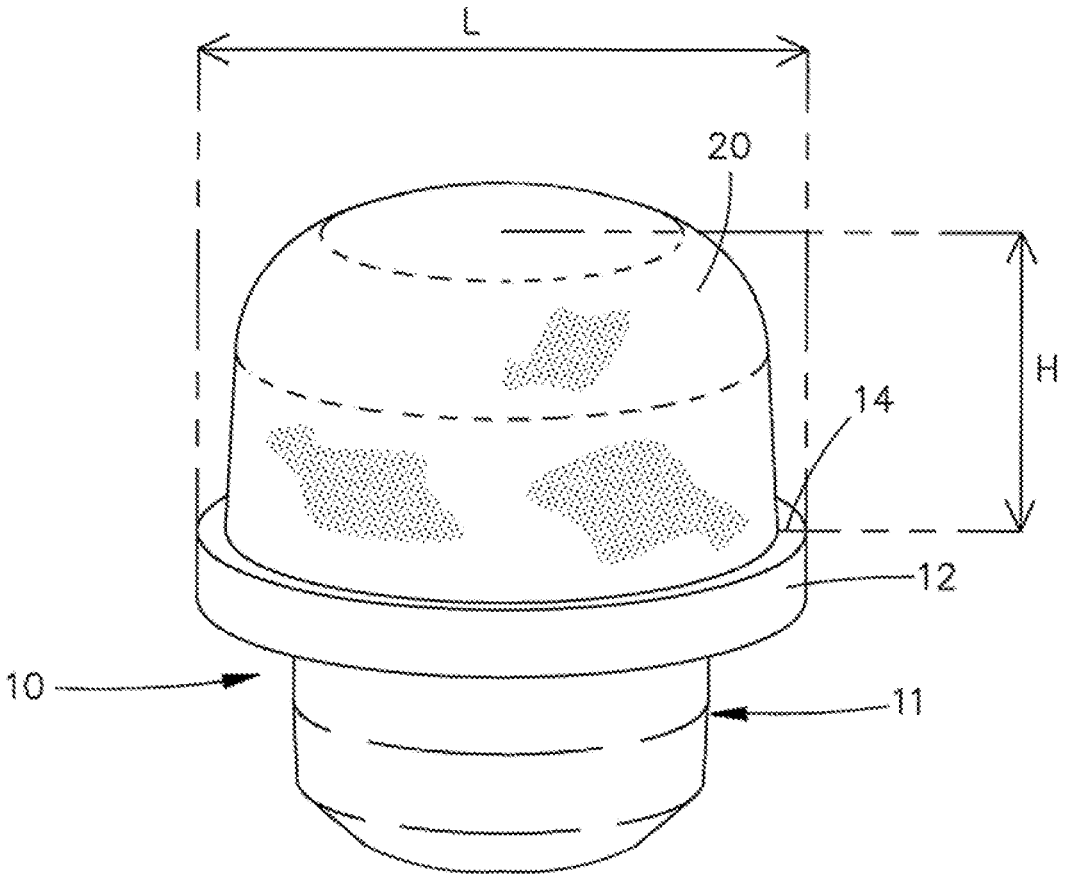
FIG. 3 is a top perspective view of the cartridge in FIG. 1 with a personal care composition attached to the flat top surface.
Figure 4:
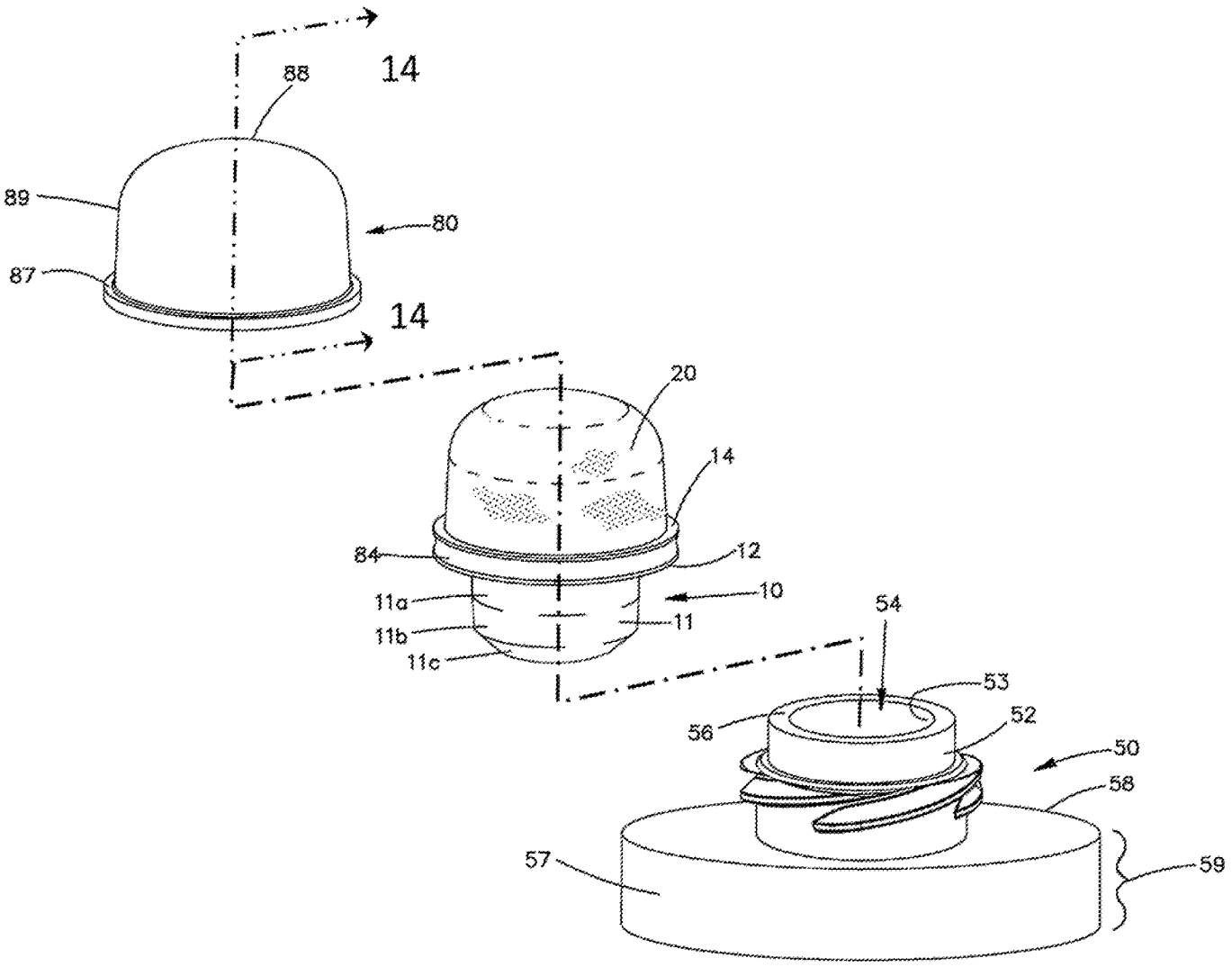
FIG. 4 is an exploded perspective view of a personal care product of the present invention that includes a sanitary cap, a cartridge, and an applicator container having a receptacle configured to receive the cartridge.

FIGS. 3 and 4 illustrate a cartridge 10 that includes a volume of a personal care composition 20 attached to an upper base 12 that has a flat top surface 14. Limiting the height of the personal care composition 20 to be shallow relative to the size of the cartridge 10 can additionally reduce the amount of the composition used per cartridge and promote its limited use. The height of the volume of personal care composition 20 can be less than or equal to the maximum length of the top surface 14, where the height of the personal care composition 20 is measured from the uppermost surface of the cartridge base 12. In one example shown in FIG. 3, the height 'H' of the personal care composition 20 on the cartridge 10 is approximately one half of the length 'L' of the flat top surface 14. However, as one skilled in the art would appreciate that the height H and the length L can be varied accordingly. The cartridge 10 can be defined having a vertical center axis, and in some embodiments, the cartridge base 12, the top surface 14, and the personal care composition 20, can be coaxial with one another. In another embodiment, the entire cartridge, including the personal care composition, can be symmetrical around the vertical center axis, as depicted in FIG. 4.

Figure 5:
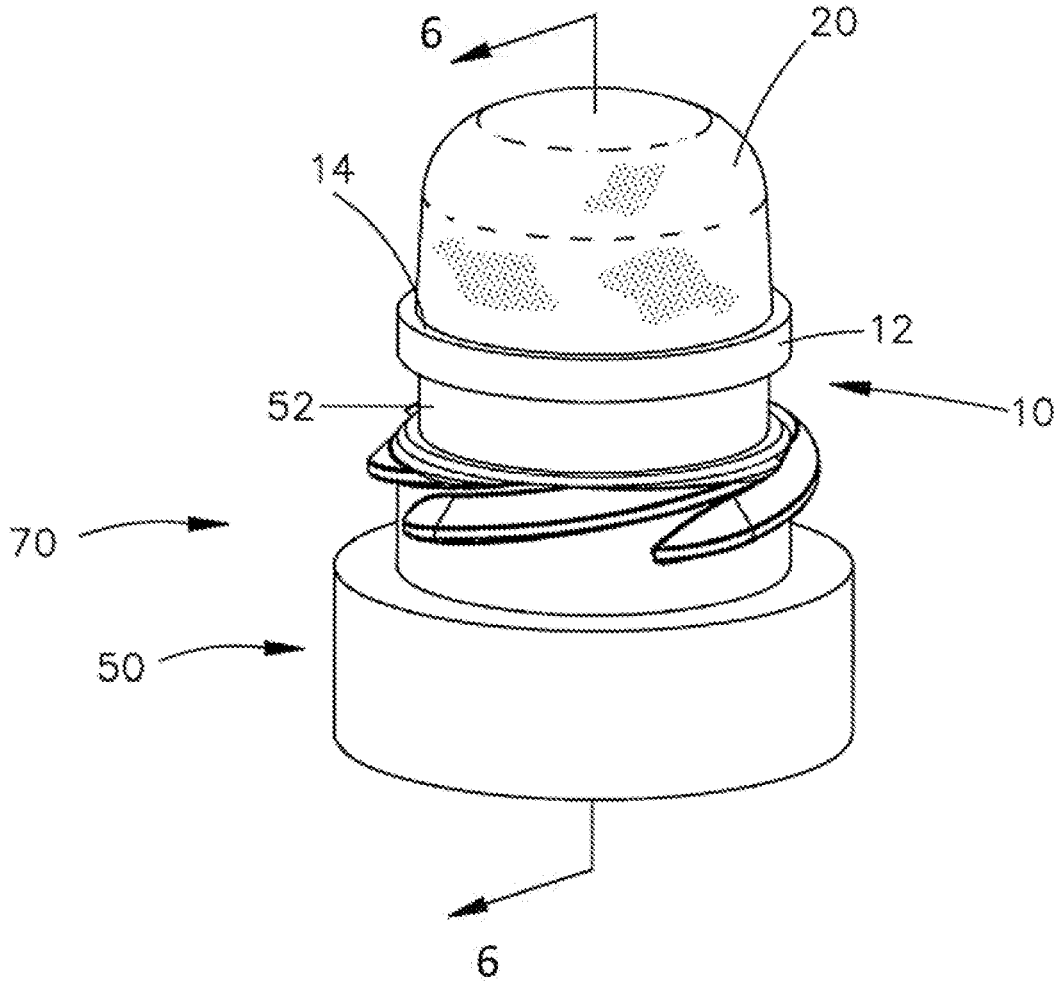
FIG. 5 is a top perspective view of the personal care product of FIG. 4 according to the present invention in which the cartridge is secured inside the receptacle of an applicator container.

FIG. 4 illustrates an exploded view of a cartridge 10 comprising the personal care composition 20, with a discardable covering shown as cap 80 configured to be disposed over the personal care composition 20, with the cartridge 10 configured for fitting or placement within an applicator container 50. FIG. 5 illustrates the cartridge 10 comprising the personal care composition 20, without the discardable cap 80, placed within the applicator container 50. FIG. 6 illustrates a sectional view through the loaded cartridge 10 fitted within the applicator container 50. The cartridge 10 is loaded into a receptacle 52 the applicator container 50, the receptacle 52 defined by an upper rim 56. Personal care or personal use product 70 comprises the cartridge 10 with the personal care composition 20, secured within the receptacle 52 of the applicator container 50. The receptacle 52 includes an annular interior sidewall 53 that defines an interior void or capturing bore 54 within the receptacle 52. As shown in the sectional view in FIG. 6, once the plug 11 of the cartridge 10 is fully inserted into the receptacle 54, a lower surface 15 of the upper base 12 sits on top of the upper rim 56 of the applicator container 50. In some embodiments, not shown but self-illustrating, the top surface 14 of the upper base can be flush with the upper rim 56 of the applicator container. Segment 11*c* of the cartridge plug 11 is press-fit against the annular interior sidewall 53 to create the frictional securement between the applicator container 50 and the cartridge 10. The cartridge plug 11 extends approximately halfway into the interior of the capturing void 54 defined by the annular interior sidewall 53. However, those skilled in the art should appreciate that the length of the cartridge plug 11 can be configured so it extends any distance into the capturing void 54 of the receptacle 52 to frictionally secure the cartridge 10 inside the applicator container 50, including but not limited to reaching the bottom surface 55 inside the receptacle 52. In some embodiments, as shown in FIGS. 5 and 6, the receptacle 52 on the applicator container 50 can also be coaxial with the body and top surface of the cartridge, as well as the personal care or personal use composition.

Figure 7:
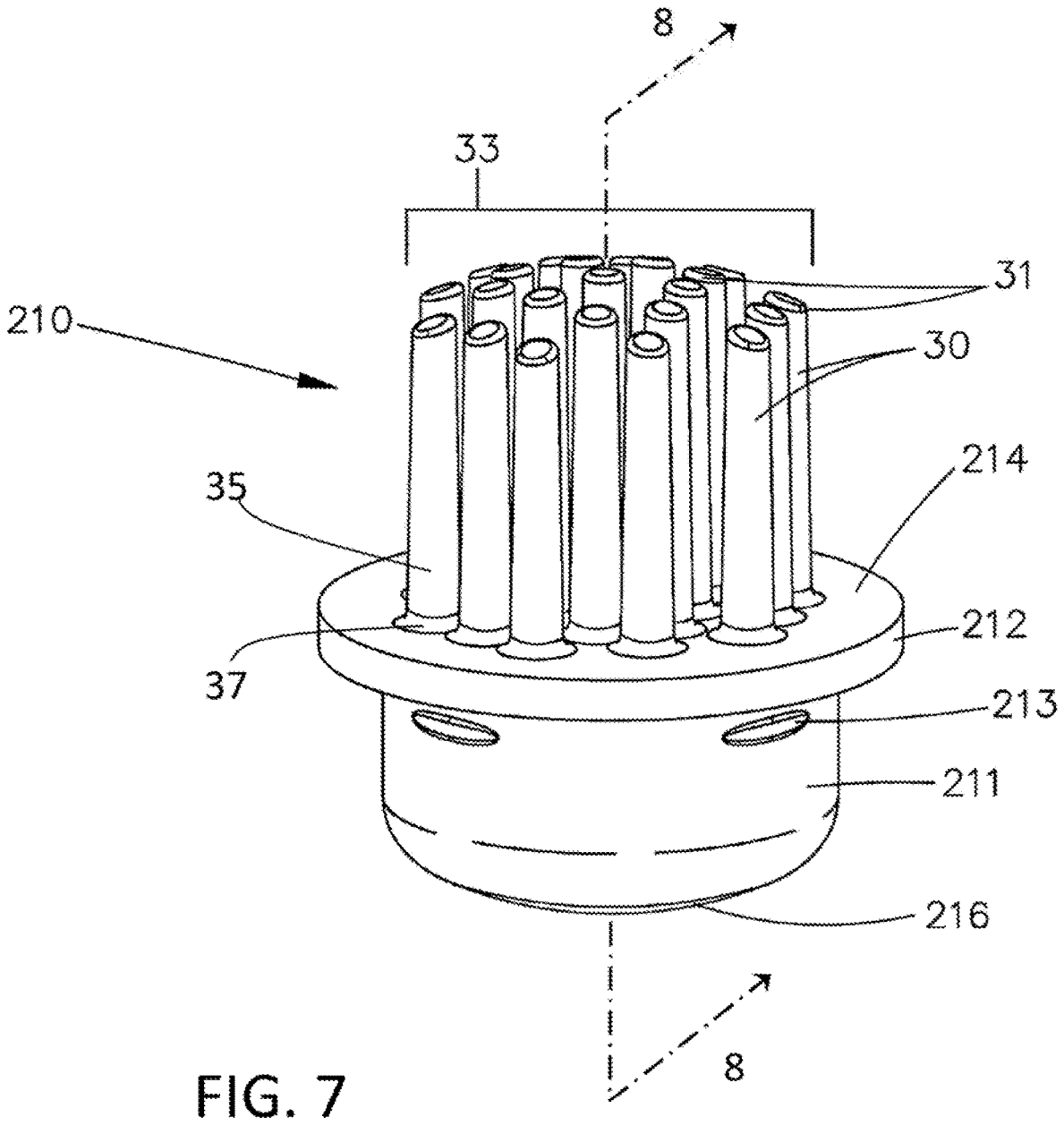
FIG. 7 is a top perspective view of an empty cartridge with a plurality of protuberances integrally attached to the top surface of the cartridge.

Furthermore, the means for securing the cartridge body 9 into an applicator container can include a receptacle in the applicator container that is configured to receive and retain the cartridge body within the receptacle. Any frictional means known in the art can also be used to secure the cartridge inside the applicator container. As a non-limiting example, the plug 11 can be press fit into and frictionally engage a portion of the annular interior sidewall 53 of the receptacle 52, securing the cartridge 10 inside the receptacle 52 of the applicator container 50, as shown in FIG. 4. Alternatively, the cartridge body 9 can be secured inside the applicator by any mechanical means known in the art. Non-limiting examples of mechanical means that can be used to secure the cartridge include a snap bead and snap detent mechanism. FIG. 7 shows one embodiment of a plurality of snap beads 213 disposed intermittently around the periphery of the wall of the plug 211. The mechanical means can also include a slide and track mechanism; a finger latch mechanism; a mounting post and receiving slot mechanism; complimentary screw threads; a lever and catch; a twist lock closure; a pair of magnets of opposite polarity; a hook material and a loop material; snap beads and snap detents; kiss locks; a snap stud and snap socket; or a buckle and a clasp.

When a cartridge 10 having a personal care composition 20 attached to a flat top surface 14 is loaded into an applicator container 50, the flat top surface 14 can be flush with, or slightly raised above, the rim of an applicator container, as shown in FIG. 6. As a result, the entire volume of the personal care composition attached to the cartridge 10 can be used without wasting or losing any of the personal care composition down inside the applicator container and without having to dip a finger down into the applicator container. Those skilled in the art should appreciate that the perimeter of a convex top surface can also be configured to be flush with, or raised above, the rim of an applicator container. Accordingly, cartridges with flat or convex top surfaces facilitate limited-use applications because only a minimal amount of a personal care composition can be attached to, or associate with, the cartridge base without spilling over the edge or creating a mess on the applicator container or the user. Attaching minimal quantities of personal care composition to the top surface of the upper base of the cartridge additionally enables the personal care composition to be concealed inside the applicator container when the personal care composition is not being applied. Concealing the personal care composition 20 from view when not in use is especially desirable when the applicator container is worn as an aesthetic personal accessory or piece of jewelry.

FIGS. 7, 8-10, and 18 illustrate a cartridge 210 with a plurality of protuberances 30 integrally attached to a flat top surface 214 of the upper base 212. The protuberances can be typically elongated, and/or extend normal to the top surface, and/or extending in parallel to one another. In some embodiments, the protuberances extend parallel to the common axis shared by the body and top surface of the cartridge. The protuberances 30 can be made by molding and can comprise the same material as the base, including but not limited to resilient materials such as thermoplastic materials or inert synthetic polymers. In some embodiments of the invention, the protuberances can be made of polysiloxane, commonly referred to as silicone.

Protuberances of different lengths can be utilized so the distal ends 31 of each of the plurality of protuberances 30 provide a shaped contact surface 33 with which the user can exfoliate his or her lips or skin during use. The contact surface 33 can be configured into any desired shape from which to exfoliate the lips or skin during application of the personal care composition 20, including but not limited to a domed surface (as illustrated in FIG. 2), a flat surface, an angled surface, or any other desired shape. The protuberances illustrated have an aspect ratio of between 5:1 to 9:1.

The cartridge 10 can also include any number of protuberances 30 in any desired pattern or arrangement to provide a combination of anchoring of the personal care or personal use composition 20 onto the cartridge along with exfoliation performance. Additionally, arrangements of protuberances can include protuberances that have a different length, diameter, or durometer than other protuberances in the same arrangement. Protuberances may also be arranged so that some protuberances in the arrangement are tightly packed together while other protuberances are comparatively spaced further apart. A personal care composition that is gel-based or loosely-packed can be attached to a cartridge that includes several protuberances that have a smaller diameter and are tightly arranged. Conversely, solid, waxy, or tightly-packed personal care compositions that can maintain their own shape can be utilized on cartridges that include protuberances that are spaced further apart or have thicker diameters, or on cartridges that do not include protuberances at all. Non-limiting examples of arrangements of protuberances on the top surface include tightly-packed protuberances in rows, concentric circles, or other patterns.

In some embodiments of the invention, the personal care composition can be embedded between the plurality of protuberances, anchoring the personal care composition to the cartridge. To more effectively anchor the personal care composition, the length, diameter, firmness, and shape of the protuberances can be tailored by one skilled in the art based on the type and characteristic of the personal care composition. A protuberance can have a length of about 1 to about 15 millimeters, particularly about 3 to about 10 millimeters, and a diameter or longest cross-sectional dimension of about 0.5 to about 5 millimeters, particularly about 1 to about 3 millimeters. A protuberance material can have a durometer on the Shore A scale of about 10 to about 70, particularly a durometer on the Shore A scale of about 25 to about 40. The protuberances can be sufficiently firm and resilient to retain their shape when the lip balm is loaded and embedded around the bristles, to retain their shape as the lip balm is applied, and to exfoliate the user's skin or lips when the personal care composition, for example a lip balm, is applied and depleted. The protuberances should be pliable and not overly elastic such that they collapse or lay over onto the surface of a remaining portion of the personal care composition embedded between them as the composition is depleted. The cross-sectional shape of a protuberance can be circular, oval, square, rectangular, other polygon, or any effective shape. Additionally, the protuberances themselves can also be formed into any desired shape or type, including but not limited to blades, bristles, nubs, or nodules. In some embodiments of the invention, the plurality of protuberances comprises a plurality of silicone bristles.

The protuberances 30 have a number of physical and material properties, and can be used in a variety of arrangements, to provide value and benefits to the user of the product. The plurality of protuberances can have a rounded, preferably smooth, distal end 31. In one embodiment, the spacing between the distal ends of adjacent protuberances is at least one protuberance-end diameter, which in one embodiment can range between about 25-40 mil (0.025-0.040 inches), and in another embodiment, about 30 mil (0.030 inches). Each of the bristles or protuberances 30 has a cylindrical outer shape, tapering slightly (about 5 degrees) outwardly from the distal end 31 to the base end 35 (see FIG. 7), which is attached integrally to the top surface 14 of the upper base 12 through a transition base 37.

In one embodiment of the invention, the density of protuberances or bristles on the top surface of the upper base is at least 10 bristles, and particularly at least 20 bristles, per square cm, and up to about 60 bristles per square cm, including about 35-45 bristles per square cm.

In an embodiment of the invention, the length of a protuberance, from the top surface of the upper base, to the distal end of the protuberance, can be at least 100 mil (0.10 inch, 2.5 mm), including at least 150 mil (0.15 inch, 3.8 mm), and up to longer lengths, for example, 1 inch (25.4 mm), and can include 180 mil (0.18 inch, 4.5 mm), 190 mil (0.19 inch, 4.75 mm), and 200 mil (0.20 inch, 5 mm).

In an embodiment of the invention, the volume of the personal care composition is typically about 0.25-10 ml, and in some embodiments about 0.5-1.0 ml. In an embodiment of the invention, the ratio of the volume of the personal care composition to the volume of the plurality of protuberances 30 is typically at least 4:1, and up to about 20:1, which can include at least 5:1, or 6:1, or 7:1, or 10:1. In another embodiment, the ratio of the total area that boundaries the plurality of protuberances to the total area of the plurality of base ends of the protuberances, is typically at least 3:1, and up to about 10:1, which can include at least 4:1, such as about 5:1, or about 6:1.

Figure 9:
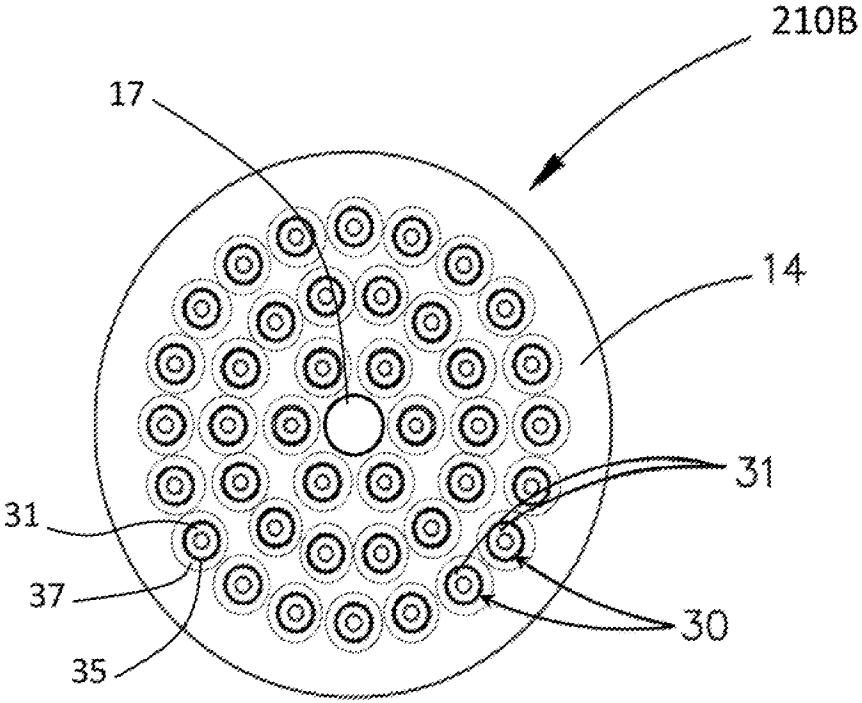
FIG. 9 is a top plan view of an alternate arrangement of the plurality of protuberances on the top surface of a cartridge.
Figure 8:
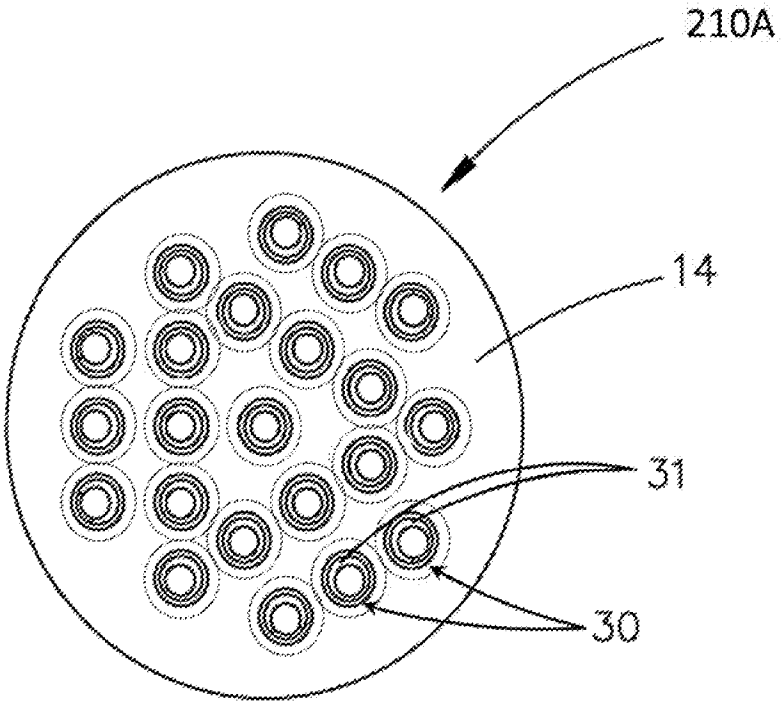
FIG. 8 is a top plan view taken of the empty cartridge in FIG. 7 showing an arrangement of the plurality of protuberances on the top surface of the cartridge.
Figure 10:
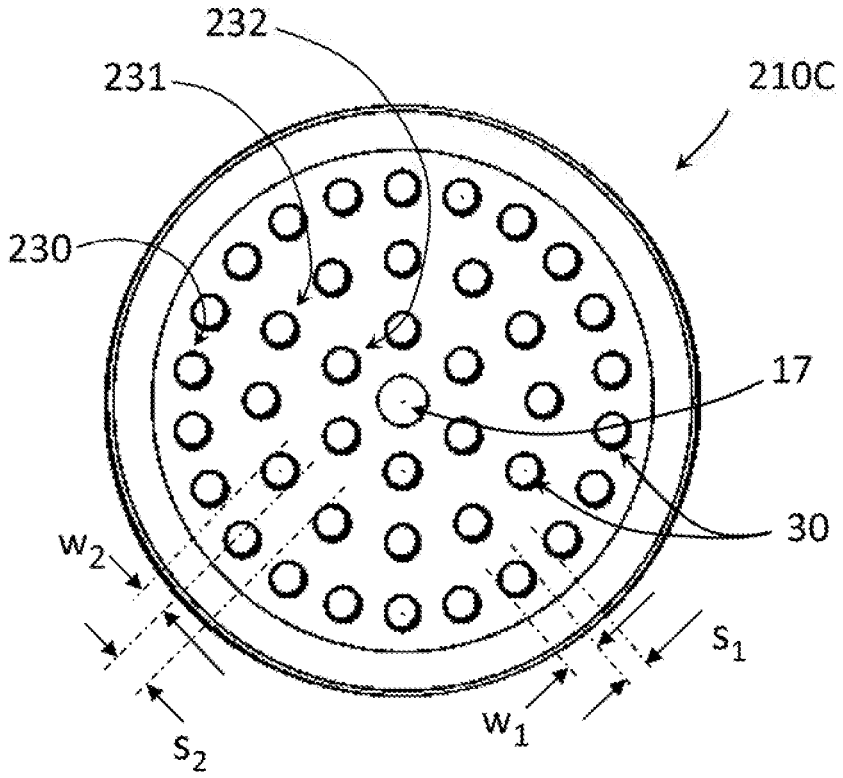
FIG. 10 is a top plan view of a further alternate arrangement of the plurality of protuberances on the top surface of a cartridge.

As illustrated in FIG. 8, the plurality of protuberances 30 can be arranged in a manner that they form the shape of a triangle, with additional protuberances 30 filling in gaps on the flat top surface 214 of cartridge 210A. In contrast, FIG. 9 shows a cartridge 210B having an alternate arrangement of protuberances 30 in a series of concentric circles. FIG. 10 shows a cartridge 210C having another alternate arrangement of protuberances 30 including an outer-most ring 230 of protuberance 30 that have a tighter packing of protuberances 30 in comparison to the intermediate ring 231 and the inner-most ring 232 of protuberances 30. As shown, the width $w_1$ of the protuberances 30 in the outer-most ring 230 is about the same as the spacing $s_1$ between adjacent protuberances 30 in the outer-most ring 230. The ratio of the protuberances width $w_1$ to the spacing $s_1$ is typically about 1.0±0.2, and alternatively about 1.0 or greater. In comparison, the width $w_2$ of the protuberances 30 in the intermediate ring 231, or the inner-most ring 232, is less than the spacing $s_2$ between adjacent protuberances 30 in the intermediate ring 231, or the inner-most ring 232. The ratio of the protuberances width $w_2$ to the spacing $s_2$ is less than the ratio for the outer-most ring 230, and is typically less than 1.0. Without being bound by any particular theory, the more densely packed protuberances in the outer-most ring 230 provide a more robust barrier, or dike or dam, against the flow laterally of the composition 20 through the outer-most ring 230, which helps to control against excessive and unwanted leakage of the composition 20 from the cartridge.

Figure 11:
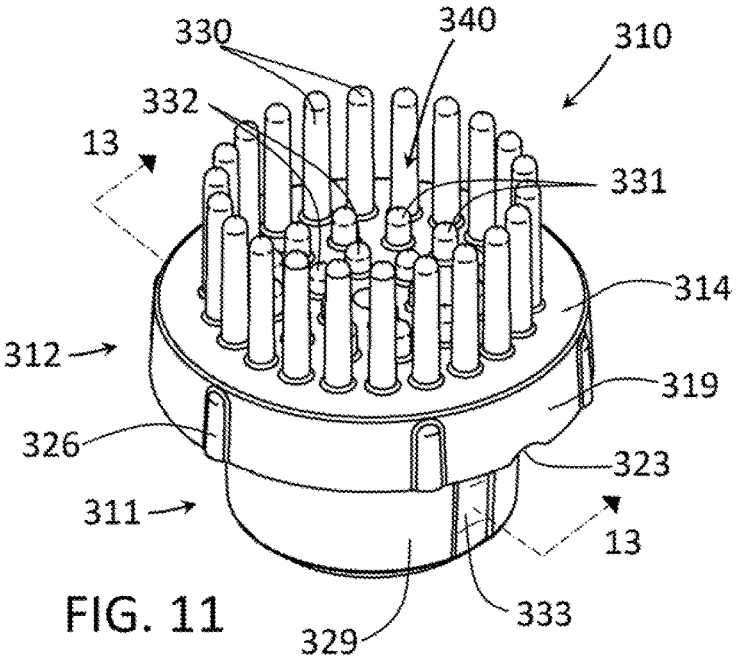
FIG. 11 is a top perspective view of another embodiment of an empty cartridge showing another arrangement of the plurality of protuberances on the top surface of the cartridge.
Figure 12:
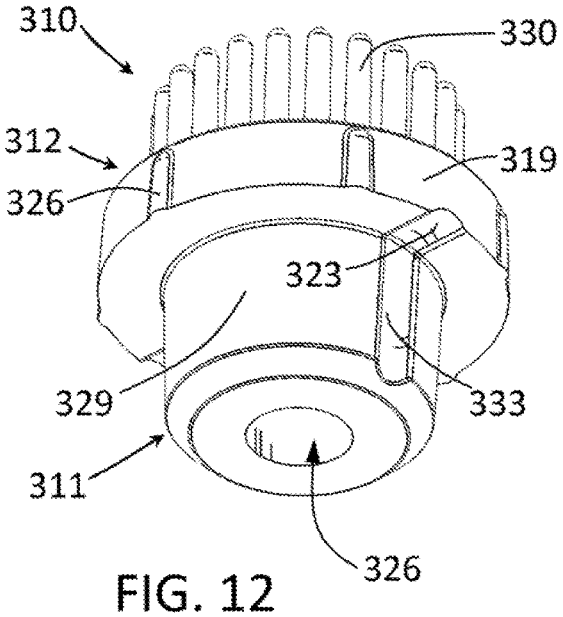
FIG. 12 is a bottom perspective view of the empty cartridge of FIG. 11.
Figure 13:
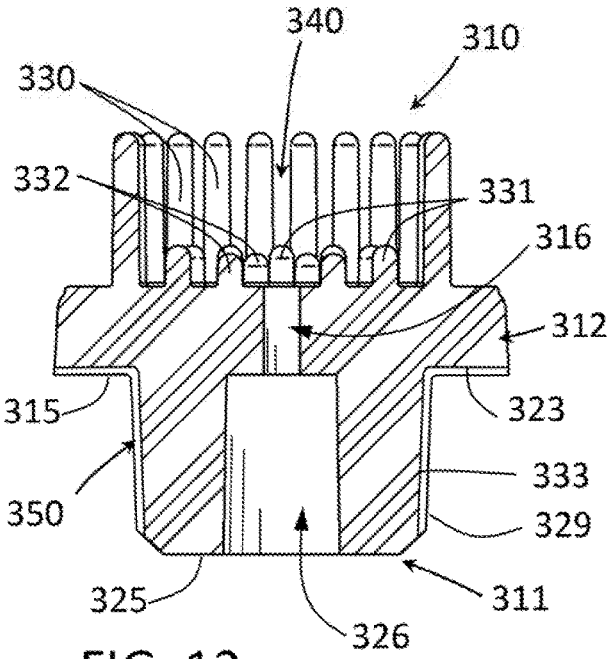
FIG. 13 is a sectional view of the empty cartridge of FIG. 11, taken along lines 13-13.

FIGS. 11, 12 and 13 illustrate another embodiment of a cartridge 310. The cartridge 310 as illustrated includes an upper base 312 that has a flat top surface 314, and a plug 311 and that extends perpendicular to, and from an undersurface 315 of, the upper base 312 in a direction opposite the protuberances. The top surface 314 of the upper base 312 supports a plurality of protuberances or bristles, including at least one outer ring of protuberances 330. Inboard of the at least one outer ring of protuberances 330 defines a center portion of the top surface 314. The protuberances also include an inner group or ring of shorter protuberances 332 that are disposed within the center portion of the top surface 314. The shorter protuberances 332 can have a shorter length relative to the longer protuberances 330, and typically less than 50%, and more particularly less than 25%, the length of the longer protuberances 330. Optionally, the plurality of protuberances can include intermediate protuberances 331, which have a length shorter than the longer protuberances 330, and can have a shorter, though more typically longer, length than the shorter protuberances 332. In the particular illustrated embodiment, the shorter protuberances 332 have an aspect ratio of about 1:1, the intermediate protuberances 331 have an aspect ratio of about 2:1, and the outer protuberances 330 have an aspect ratio of about 6:1. At least 50% of the protuberances have an aspect ratio of about 6:1.

The first, longer protuberances 330 define an open cavity 340 having an area bounded by the longer protuberances 330, and occupying a space above the top surface 314, the shorter protuberances 332, and the intermediate protuberances 331. The reduced length of the shorter protuberances 332 and/or intermediate protuberances 331 provide a greater volume within the open cavity 340 for the personal care composition, while having a length sufficient to provide anchoring of the personal care composition deposited into the open cavity 340. The length of the shorter protuberances 331 and/or 332 may also be sufficient to contribute to the exfoliation performance of the cartridge.

The upper base 312 has a through bore 316, while the plug 311 has a through bore 326 in fluid communication with the bore 316 of the upper base 312, where the through bore 326 is at least twice the diameter or size of that of the bore 316. The plug 311 has an outer sidewall 329 that has a taper 328 at the bottom 325.

In an embodiment of the invention, the plug 311 has an axially-extending groove 333 formed into its outer sidewall 329, from proximate the bottom 325 of the plug 311, to the juncture of the plug 311 with the upper base 312. The groove 333 aids in venting air that might be trapped within a capturing void 54 of a receptacle 52 (see, for example, FIG. 6), which otherwise becomes compressed and resists insertion of the plug of the cartridge into the receptacle. The air escapes from within the receptacle along the groove 333 as the plug 311 descends into the receptacle. In yet another embodiment, the upper base 312 has a broad radially-extending groove 323 formed into the under surface 315, extending from the juncture of the plug 311 with the upper base 312, to the outer sidewall 319 of the upper base 312. The radial groove 323 can intersect and join with the axial groove 333 to provide a unitary channel 350 that provides fluid communication from the bottom 325 of the plug 311 to the sidewall 319 of the upper base 312. These features can aid in the venting of air that might be trapped within a capturing void 54 of a receptacle 52 (see, for example, FIG. 6), which otherwise becomes compressed and resists insertion of the plug of the cartridge into the receptacle. In the illustrated embodiment, there are two opposed vent channels 350, consisting of the two axial groove 333 and the two radial grooves 323, on opposite lateral sides of the plug 311, although other number and arrangements of vent channels, and vent channels of other cross-sectional shapes, surfaces and depths, can be used.

In an alternative embodiment, a capturing void of a receptacle, such as that shown in FIG. 6, can be provided with one or more similar vent grooves along the interior sidewall 53 and upper rim 56 of the receptacle, to define a vent channel in the receptacle 54.

In another embodiment of the invention, the upper base 12 can include one or more ribs or raised members 360 disposed on the outer sidewall 319, typically distributed around the periphery or circumference. The ribs or raised members 360 can provide a grasping point for gripping and rotating the cartridge 320, for example, to rotate the cartridge 320 when removing it from a receptacle.

It should be appreciated by those skilled in the art that the example depicted in FIGS. 8 through 13 are non-limiting illustrations only, and that the protuberances may be arranged on the top surface of the cartridge base in any pattern, arrangement, number, length, shape, durometer, or diameter desired or necessary to anchor a particular personal care composition to the cartridge.

Figure 18:
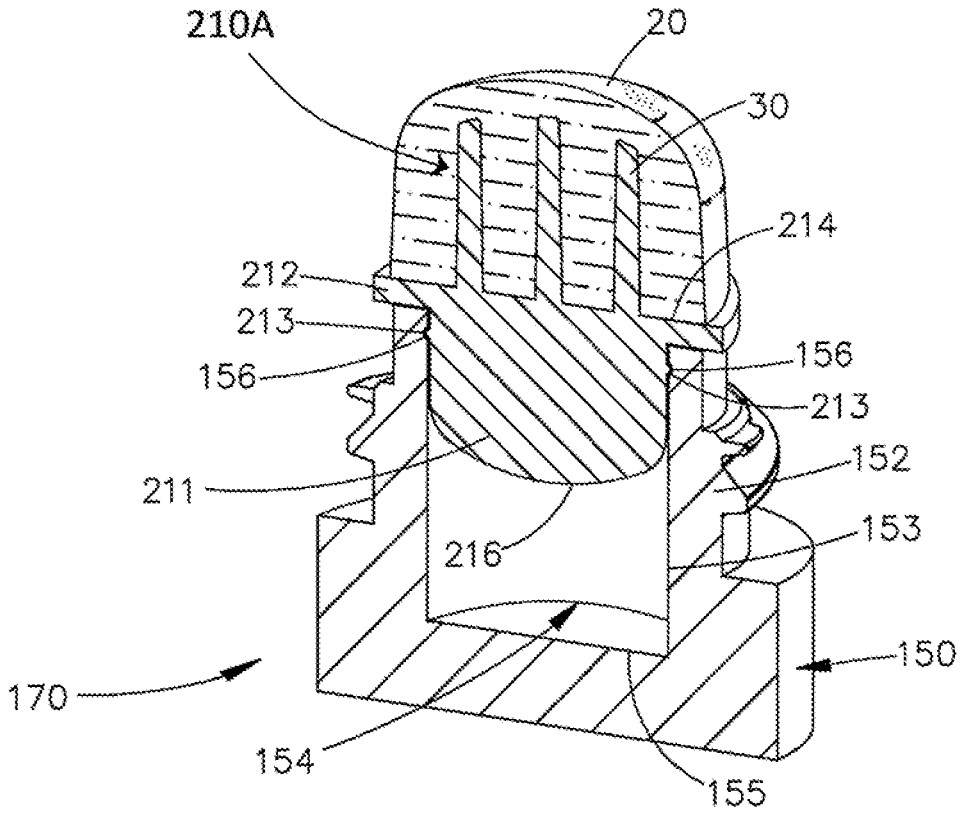
FIG. 18 is a sectional view of a personal care product according to the present invention that includes a cartridge having a personal care composition embedded between a plurality of integrally-attached protuberances, secured inside the receptacle of an applicator container.

FIG. 18 illustrates a sectional view of a personal care product 170 that includes a cartridge 210 with a personal care composition 20 embedded between a plurality of integrally-attached protuberances 30 that has been loaded into an applicator container 150. As the personal care composition is applied on the lips or skin of the user and the quantity of the personal care composition attached to the cartridge is depleted, the protuberances become exposed until there is eventually no personal care composition remaining that can be applied.

FIG. 18 also demonstrates a mechanical snap fit between the cartridge 210 and the applicator container 150. The cartridge body 211 can include one or more projections 213 that can be loaded or snapped into one or more notches 156 in the sidewall 153 defining the interior capturing void 154 of the receptacle 152. FIG. 18 shows that the bottom surface 216 of the cartridge body 211 projects approximately halfway into the interior capturing void 154 of the receptacle 152. Nevertheless, the length of the cartridge body 211 can be configured to extend any distance into the interior capturing void 154, including touching the bottom surface 155 of the receptacle 152. Similarly, a cartridge 210 that includes a plurality of integrally-attached protuberances can be configured to be loaded and secured inside the applicator container by any means known in the art, including a frictional securement, as seen in FIG. 4.

In one example of the cartridge of the invention, the top surface 14 of the upper base 12 has a diameter of 0.55 inch, and the plurality or matrix of bristles has total diameter of about 0.45 inches, and a uniform height of about 0.20 inches.

Although the above examples illustrate cartridges with protuberances integrally attached to a flat top surface of the base, protuberances can additionally be attached to cartridges with top surfaces that are convex, planar, or concave. As with cartridges having a flat top surface, the lengths of each of the plurality of protuberances on a convex top surface can be identical to each other to form a domed contact surface, similar to that shown in FIG. 7. Similarly, a plurality of identical-length protuberances on a concave top surface can form a recessed contact surface. Additionally, the lengths of each of the plurality of protuberances can be appropriately varied on convex or concave top surfaces to provide a flat contact surface, or the lengths can be otherwise varied to create any desired arrangement and layout of the protuberances on the top surface of the cartridge base.

In another embodiment, the plurality of protuberances can be formed integrally to a sheet of flexible or resilient material, extending normally to the plane of the sheet, which can be then applied and affixed securely to the upper surface of the upper base.

In some embodiments of the invention, the cartridge may additionally include a removable or discardable covering which envelops to protect the personal care composition and keep it sanitary either prior to loading the cartridge into an applicator container or prior to the first application of the personal care composition on the lips or skin of the user. The discardable covering may be configured to any shape necessary to prevent the personal care composition from contacting any surfaces outside of the cartridge, including the applicator container in which the cartridge is loaded, and may include adhesives to ensure a proper seal with the cartridge. The sanitary covering may additionally include a tab or another means known to those skilled in the art to facilitate removal of the sanitary covering from the cartridge.

In another embodiment, the discardable covering can be a rigid or resilient cap. As shown in FIGS. 4 and 14-17, the cap 80 includes an upper wall 88, a cylindrical sidewall 89, and an annular lower rim 87 that defines a closed end, and can be configured to envelop or encapsulate the personal care composition 20 and remain in place until the user decides to remove the cap 80. In some embodiments, as shown in FIG. 16, the cap 80 includes an annular rib 86 that can form a snap fit with a corresponding annular groove 84 on the cartridge base 12 or 212. However, the cap can be configured to be releasably fastened to the cartridge base by any means known in the art.

Figure 15:
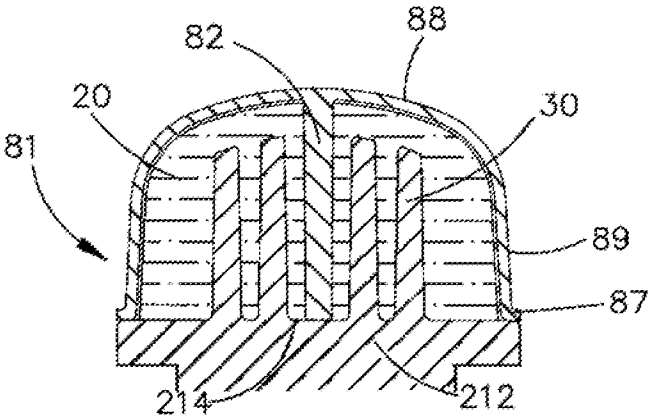
FIG. 15 is a sectional view taken along line 15-15 of the cap shown in FIG. 4 secured to a cartridge base and enveloping a personal care composition.
Figure 14:
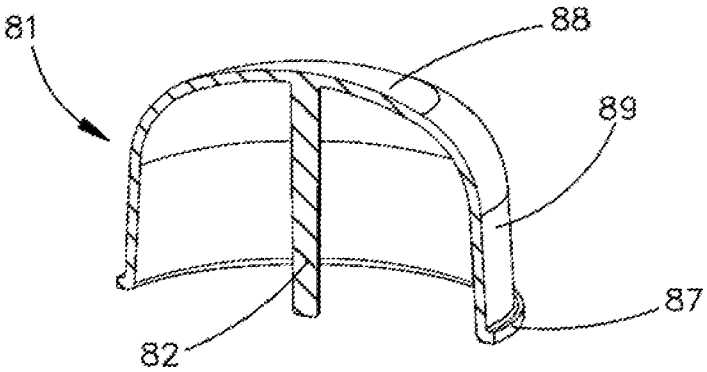
FIG. 14 is a sectional view taken along line 14-14 of the cap shown in FIG. 4 for a personal care composition.
Figure 17:
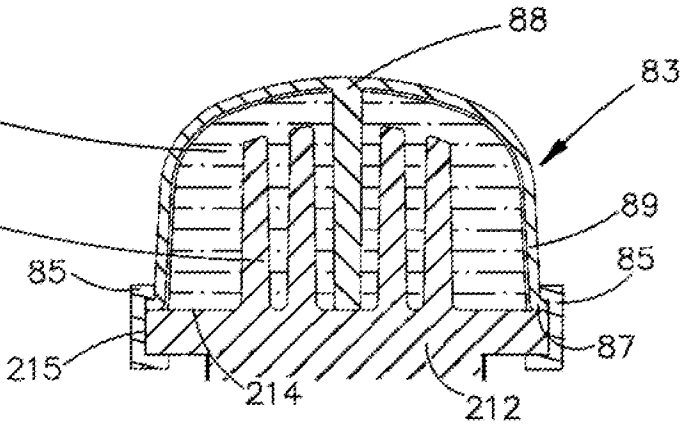
FIG. 17 is a sectional view of yet another alternate embodiment of a cap that can be used to envelop a personal care composition, secured to a cartridge base by a protective wrap.
Figure 16:
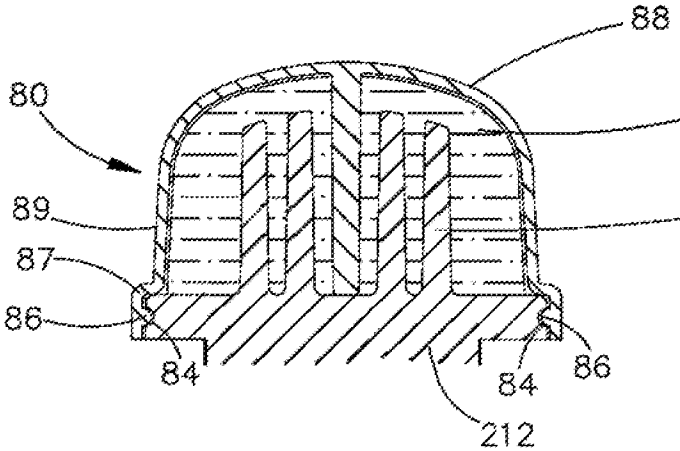
FIG. 16 is a sectional view of an alternate embodiment of a cap that can be used to envelop a personal care composition, secured to a cartridge base.

Additional non-limiting examples of caps that can be utilized to envelop or encapsulate the personal care composition are provided in FIGS. 14, 15, and 17. FIGS. 14 and 15 illustrate a cap 81 that has a cap projection 82 that extends axially from an inner surface of the upper wall 88 and into the personal care composition 20 when the cap 81 is secured to the cartridge base 212 or the personal care composition 20. The cap projection 82 provides a rigid body through which a user can apply pressure to frictionally secure the cartridge into a receptacle of an applicator container without damaging the personal care composition. Conversely, FIG. 17 shows a cap 83 that rests atop the top surface 214 of the cartridge base 212 without projecting into the personal care composition 20. One or more protecting wraps 85 can temporarily secure the annular lower rim 87 of the cap 83 to the perimeter edge 215 of the cartridge base 212. In some embodiments, the protecting wrap 85 is shrink wrap. Any of the caps 80, 81, or 83 may be discarded after initially being removed from the cartridge, or they can be reinstalled after each application to provide an additional layer of protection for the personal care composition when not in use. A cap can be formed out of metallic, thermoplastic, or silicone-based materials. In some embodiments, the cap is plastic.

In some embodiments, where the volume of a personal care composition on a cartridge has been depleted, a fresh quantity of personal care composition can be loaded by hand onto the base of an empty cartridge having a plurality of attached protuberances by swiping or submerging the top surface of cartridge base into a larger volume of the personal care composition. This allows the same cartridge to be reloaded multiple times rather than switching to a new cartridge.

In some embodiments, both pre-loaded and manually-loaded cartridges can be secured in the receptacle of any applicator container configured to receive the cartridge, including commonly-available applicator containers, with such non-limiting examples as lip balm tubes, lipstick applicators, makeup or cosmetic containers, and other dispensing apparatuses, such as the chapstick dispensing apparatus discussed in U.S. Pat. No. 6,283,658 or the freshening ring described in U.S. Pat. Pub. 2013/0014312. Cartridges can also be loaded and secured within the applicator containers of commercially-available personal care products, particularly lip balm products, once their contents have been partially or fully depleted, thereby "recharging" the container for reuse and preventing the user from having to throw away a previously purchased or used applicator container.

Commercially-available personal care products can include, but are not limited to, products having different manufacturing origins, sold at different retailers, or packaged separately from the cartridges of the present invention. Furthermore, cartridges having a plurality of attached protuberances can be secured within receptacles inside commercially-available products that have applicator containers with receptacle sidewalls that extend above the top surface of the cartridge. As a result, personal care composition can be attached to or fixed on an empty cartridge having a plurality of protuberances either prior to loading the cartridge into the commercially-available personal care product's applicator container, or after the cartridge has been secured inside its receptacle.

As described above, the personal care composition can be applied by the user by hand directly from the cartridge itself, or after being loaded into an applicator container. Any applicator container known in the art can be adapted to receive and secure the cartridge, including those mentioned above. In some embodiments, the applicator container can be a piece of jewelry or a wearable accessory. Non-limiting examples of jewelry or wearable accessories that can be adapted to be applicator containers can include jewelry includes necklaces, lockets, bracelets, watches, armlets, amulets, bangles, rings, cuff links, broaches, charms, pendants or medallions. The applicator container can also be configured to be mounted or secured onto fixed or portable surfaces, including but not limited to desks, car dashboards, dressers, purses, duffel bags, ID badge holders, or athletic equipment. Applicator containers can be formed from any material or combination of materials, including but not limited to jewelry-grade precious metals such as platinum, gold, or silver; less expensive metals such as aluminum or copper, metal alloys such as steel, molded thermoplastics, wood, ceramics, glass, fabrics, leather, or woven materials.

Applicator containers can also be configured to any desired shape. In some embodiments, an applicator container 50 can further be defined by an outer wall 57, as shown in FIG. 4, at least a portion of the outer wall defined by a cross-section normal to the common axis has a shape that is elliptical or oval. The elliptical portion 58 of the outer wall 57 can define an elongate or arcuate gripping surface 59 that can be configured to fit between the base of the user's thumb and forefinger during single-handed operation of the applicator container 50, allowing the user to more easily fasten or unfasten the closure and apply the personal care composition to his or her skin or lips. Applicator containers that are elliptical or oval-shaped can also be configured to rest flat against the chest of a user when the applicator container is worn as a necklace or locket, which can help conceal the applicator container and make it more comfortable to wear.

To further secure the cartridge inside the applicator container, the applicator container can also include a removable closure to protect the loaded cartridge when the personal care composition is not being applied to one's lips or skin. The closure can be frictionally or mechanically fastened to the applicator container by any means known in the art. To mechanically fasten the closure to the applicator container, the applicator container can additionally include a first fastener element that is complementary to a second fastener element that is included on the closure. The first fastener element and the second fastener element can comprise a fastener which releasably fastens the removable closure to the applicator container. Any suitable fastener commonly incorporated onto jewelry or personal accessories may be used, including but not limited to a friction fit, a lever and catch, kiss locks, a twist lock closure, a mounting post and post-receiving slot mechanism, a snap stud and snap socket, snap beads and snap detents, a buckle and clasp, a hook material and a loop material, complementary screw threads, or a pair of magnets of opposite polarity. Additionally, the closure can incorporate ornamental or aesthetically-pleasing design elements to increase the attractiveness of the piece of jewelry as well as conceal the presence of a cartridge inside the applicator container.

Figure 19:
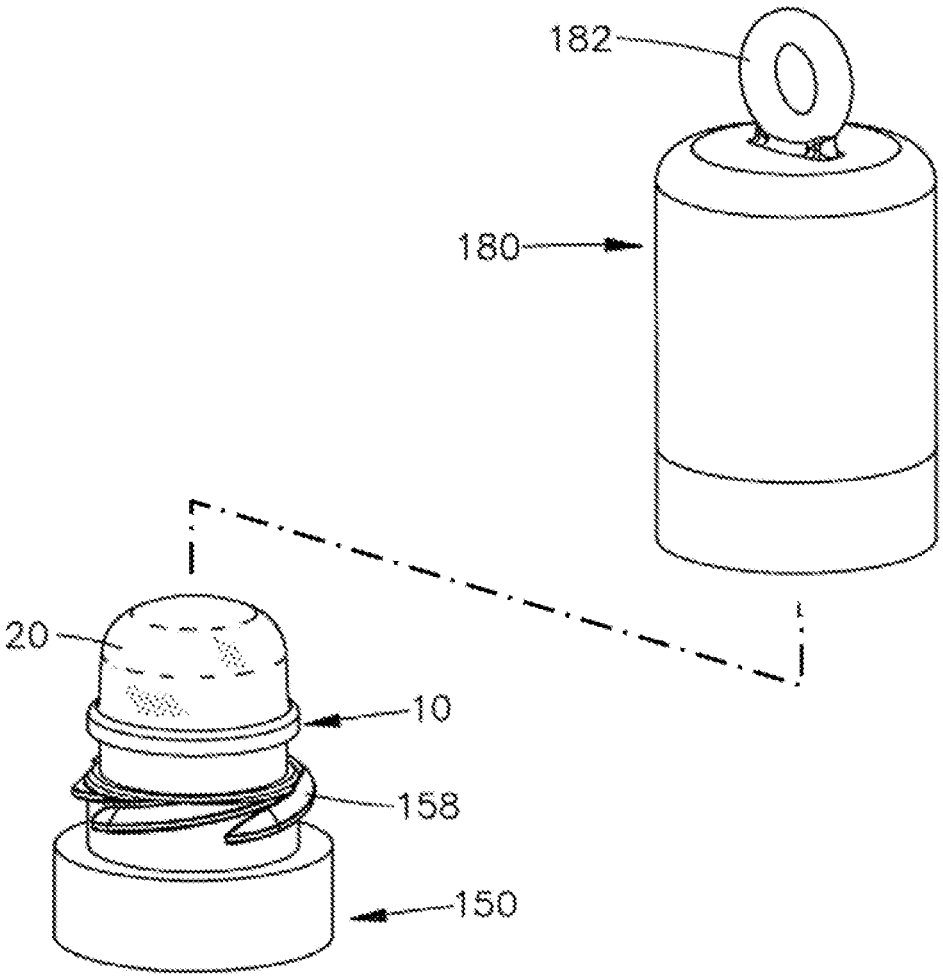
FIG. 19 is an exploded perspective view an alternative embodiment of a personal care product of the present invention and an exemplary cover that can be releasably fastened to the applicator container.
Figure 20:
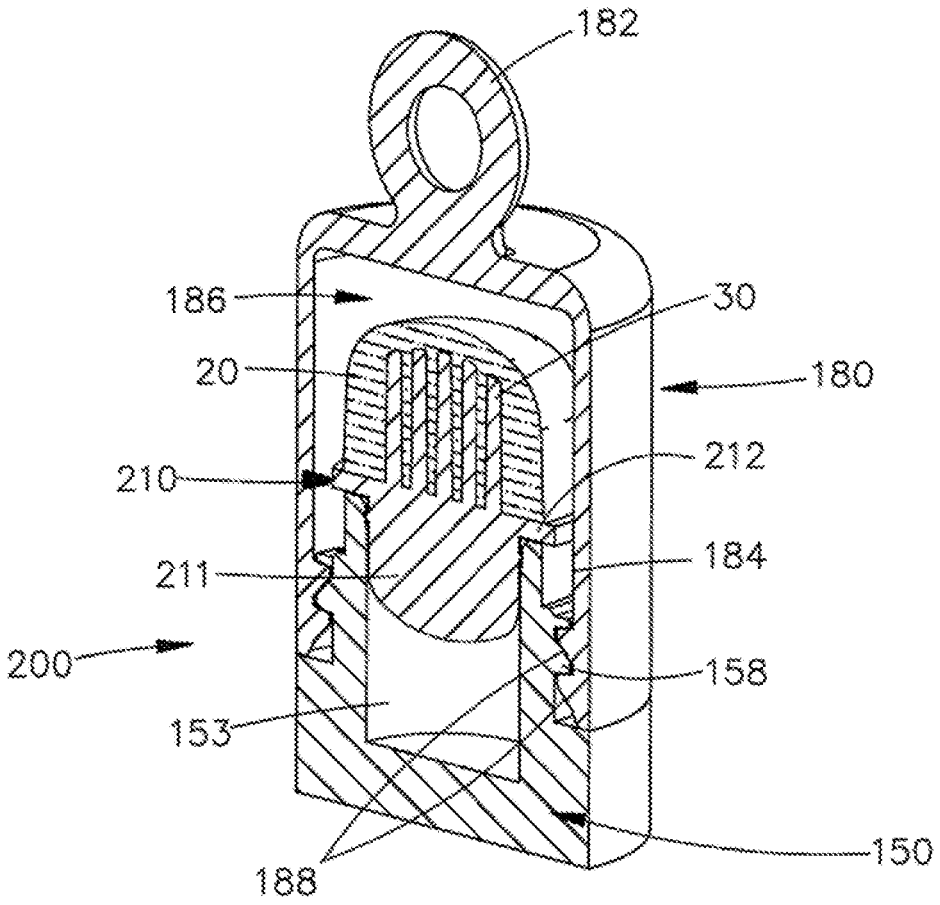
FIG. 20 is a sectional view of a locket formed by fastening a removable cover to the applicator container, with a cartridge secured inside the applicator container.

As a non-limiting example, FIGS. 19 and 20 illustrate a cover 180 having female screw threads 188 that can be fastened to an applicator container 150 having complimentary male screw threads 158 to form a locket 200. The cover 180 includes an external loop structure 182 through which a chain, string, lanyard, or a similar structure can be threaded, enabling the locket 200 to be worn as a piece of jewelry. As illustrated by the sectional view of the locket 200 in FIG. 19, the cover 180 includes an interior side wall 184 that defines an interior void 186 inside the cover 180. The interior void 186 separates the personal care composition 20 from the interior sidewall 184 of the cover 180, ensuring that neither the locket 200 or items in the external environment contact the personal care composition 20 while it is being stored in between uses.

In some embodiments, a removable closure is separable from the applicator container entirely, as shown in FIGS. 19 and 20. In other embodiments, the closure can be connected to the applicator container by a hinge. Upon releasing the fastener, the closure can be moved away from the applicator container until the user has unimpeded access to apply the entire remaining volume of the personal care composition. Connected closures can be fastened to the applicator container by any of the mechanical fasteners described above.

As described above, the cartridges are intended to contain or hold a limited quantity of a personal care composition. After the personal care composition has been fully depleted from the cartridge that is loaded into a flat container, the cartridge may be removed the container, discarded, and replaced by a fresh cartridge. Cartridges may be removed by any common means known in the art, including but not limited to grasping the upper base of the cartridge and pulling it out of the applicator container, inverting the applicator container, releasing a mechanical fastener between the cartridge and applicator container, or incorporating additional design elements into the container to eject the cartridge, such as a button or a lever. Additional non-limiting examples of ejectors include a threaded rod and a turnwheel or an elevator that controls a platform. Numerous similar design elements can be utilized in the same fashion by those skilled in the art to facilitate removal of a cartridge from other flat containers.

While the present invention has been illustrated by the description of embodiments and examples thereof, it is not intended to restrict or in any way limit the scope of the appended claims to such detail. Additional advantages and modifications of the details of the invention will be readily apparent to those skilled in the art. Accordingly, departures may be made from such details without departing from the scope of the invention.

I claim:

1. A cartridge configured for containing a personal care composition and for mounting in an applicator container, consisting of:

a) a resilient body made of silicone, consisting of an upper cylindrical base having a top surface and an under surface, and a cylindrical plug having an outer annular sidewall, the plug having a bottom surface and extending from the under surface of the upper cylindrical base to the bottom surface, wherein the top surface of the upper cylindrical base and the outer sidewall of the plug are coaxial around a common axis, wherein a height of the cylindrical plug extending from the under surface of the upper cylindrical base to the bottom surface is greater than a height of the upper cylindrical base from the top surface to the under surface, and b) a plurality of free-standing, resilient, elongated bristles made of silicone, each bristle having a distal end and a proximal end, the proximal end only integrally attached to and extending from the top surface of the upper cylindrical base, the plurality of bristles extending parallel to the common axis and having a length of about 1 millimeter to about 10 millimeters, and an aspect ratio of the length to a diameter of about 1:1 to about 8:1.

2. The cartridge according to claim 1 wherein the aspect ratio is up to about 6:1.

3. The cartridge according to claim 1 wherein the plurality of bristles includes at least one outer ring of first, longer bristles having a length, and define a center portion of the top surface, and an inner group of shorter bristles that disposed within the center portion and a shorter length relative to the longer bristles, thereby defining an open cavity that has an area bounded by the at least one outer ring of first, longer bristles, and having a space above the top surface and the inner group of shorter bristles.

4. The cartridge according to claim 3 wherein the resilient body has a cylindrical bore formed axially within the cylindrical plug.

5. The cartridge according to claim 4 wherein the cylindrical bore extends through both the bottom surface of the cylindrical plug and the top surface of the upper cylindrical base.

6. A product cartridge comprising the cartridge according to claim 1, and a volume of a composition at least partially embedded between the plurality of bristles to improve anchoring the composition to the cartridge.

7. The product cartridge according to claim 6 wherein the composition is lip balm.

8. A product comprising the product cartridge according to claim 6, and an applicator container having a cylindrical bore, as a receptacle for receiving and securing releasably the cylindrical plug of the resilient body of the product cartridge.

9. The product according to claim 8 wherein the top surface of the upper cylindrical base of the cartridge is flush with or raised above an upper rim of the receptacle.

10. The product cartridge according to claim 6, wherein the composition comprises a personal care composition selected from the group consisting of a solid material, a semi-solid material, a gel material, and a wax material.

11. The product cartridge according to claim 10 further including a discardable covering that envelops the personal care composition, where the discardable covering is configured to be removed:

a) prior to loading the product cartridge into an applicator container, or b) after loading the product cartridge into an applicator container, and prior to the first application of the personal care composition on the lips or skin of the user.

12. The product cartridge according to claim 10, wherein the personal care composition can be applied for cosmetic, therapeutic, hygienic, or skin-care applications.

13. The product cartridge according to claim 12, wherein the personal care composition is selected from the group consisting of a lip balm, a lip gloss, a lipstick, a mascara, a foundation, a concealer, a blemish remover, a cream, an aloe, a lotion, an ointment, and a deodorant.

14. The cartridge according to claim 1 wherein the bristles have a diameter of about 1 millimeter to about 3 millimeters.

15. The cartridge according to claim 1 wherein the cylindrical plug has an axially-extending groove in the outer sidewall, from proximate a bottom of the cylindrical plug to a juncture of the cylindrical plug with the upper cylindrical base.

16. The cartridge according to claim 15 wherein the upper cylindrical base has a radially-extending groove formed into the under surface that intersects and joins with the axially-extending groove of the cylindrical plug, and extends to the outer sidewall of the upper cylindrical base.

17. The cartridge according to claim 1 wherein the bristles have a hardness on a Shore A durometer scale of about 25 to about 40.

* * * * *